US005197866A

United States Patent [19]

Kim

[11] Patent Number: 5,197,866

[45] Date of Patent: Mar. 30, 1993

[54] AIR PUMP FOR A NATURAL MINERAL WATER BOTTLE

[76] Inventor: Cheong-Ho Kim, Seoul Garden Apt. 3-603, 555 Dobong-dong, Dobong-gu, Rep. of Korea

[21] Appl. No.: 687,797

[22] Filed: Apr. 19, 1991

[30] Foreign Application Priority Data

Apr. 21, 1990 [KR] Rep. of Korea ..... 90-4952

[51] Int. Cl.[5] ..... F04B 43/08; B65D 83/14

[52] U.S. Cl. ..... 417/472; 222/209; 222/401; 417/118

[58] Field of Search ..... 417/472, 118, 137; 222/401, 209

[56] References Cited

U.S. PATENT DOCUMENTS

| | | | |
|---|---|---|---|
| 1,795,510 | 3/1931 | Schanze | 222/401 |
| 2,223,256 | 11/1970 | Kross | 222/209 |
| 3,323,689 | 6/1967 | Elmore | 222/209 |
| 3,905,520 | 9/1975 | Nishioka | 222/209 |
| 4,113,147 | 9/1978 | Frazier | 222/401 |
| 4,238,054 | 12/1980 | Chen | 222/209 |
| 4,274,562 | 6/1981 | Medeiros | 222/401 |
| 4,310,104 | 1/1982 | Takasuhi | 222/209 |
| 4,550,864 | 11/1985 | Tarozzi | 222/209 |
| 4,622,889 | 11/1986 | Chappell | 222/209 |
| 4,655,690 | 4/1987 | Boedecker | 417/472 |
| 4,711,377 | 12/1987 | Brown | 222/401 |
| 4,732,549 | 3/1988 | von Schuckmann | 417/472 |
| 4,863,070 | 9/1989 | Andris | 417/472 |
| 4,957,218 | 9/1990 | Ford | 222/401 |
| 4,986,452 | 1/1991 | Takatsuki | 222/209 |

FOREIGN PATENT DOCUMENTS

| | | | |
|---|---|---|---|
| 513233 | 5/1955 | Canada | 222/209 |

*Primary Examiner*—Richard A. Bertsch
*Assistant Examiner*—Peter Korytnyk
*Attorney, Agent, or Firm*—Millen, White & Zelano

[57] ABSTRACT

The invention pertains to an air pump for a natural mineral water bottle. The pump comprises a cover member, a bellows member disposed within the cover member and a stopper member fixed to the mouth of the bottle by screwing a locking nut so that the bottle may be stood up and the supply of water can be freely adjusted at user's option.

3 Claims, 5 Drawing Sheets

AIR PUMP FOR A NATURAL MINERAL WATER BOTTLE

BACKGROUND OF THE INVENTION

The present invention relates to an air pump for dispensing bottled natural mineral water for consumption. In the prior art, it is an inconvenience that the bottle has to be inclined at an angle in order to pour the mineral water into a glass. The need to handle the bottle in order to pour the mineral water through the spout often results in the accidental mishandling of the bottle and catastrophic results.

In order to solve these defects, water bottles installed in home and offices are stood upside down and are fixedly mounted by a separate supporting means with a button-type valve mounted into the mouth of the bottle so that the water is drained by pressing the valve. However, such an arrangement occupies unnecessary space and incurs the wasteful expense of installation due to the use of the separate supporting means. Also, mounting the water body in the upside down position does not provide a sense of security since it can be considered unstable by its users.

SUMMARY OF THE INVENTION

In view of the foregoing, it is the main object of this invention to provide an air pump which gives a sense of security by using a stand-up water bottle and reduces expense by which water is smoothly drained and the water of the bottle bottom is lifted up so as to prevent the water from remaining in the bottom. Further, it provides a convenience that the content of the water can be freely adjusted at user's option for use.

BRIEF DESCRIPTION OF DRAWINGS

This invention will become more clear by reference to the description, taken in connection with the accompanying drawings, in which.

DETAILED DESCRIPTION

Figure 1:
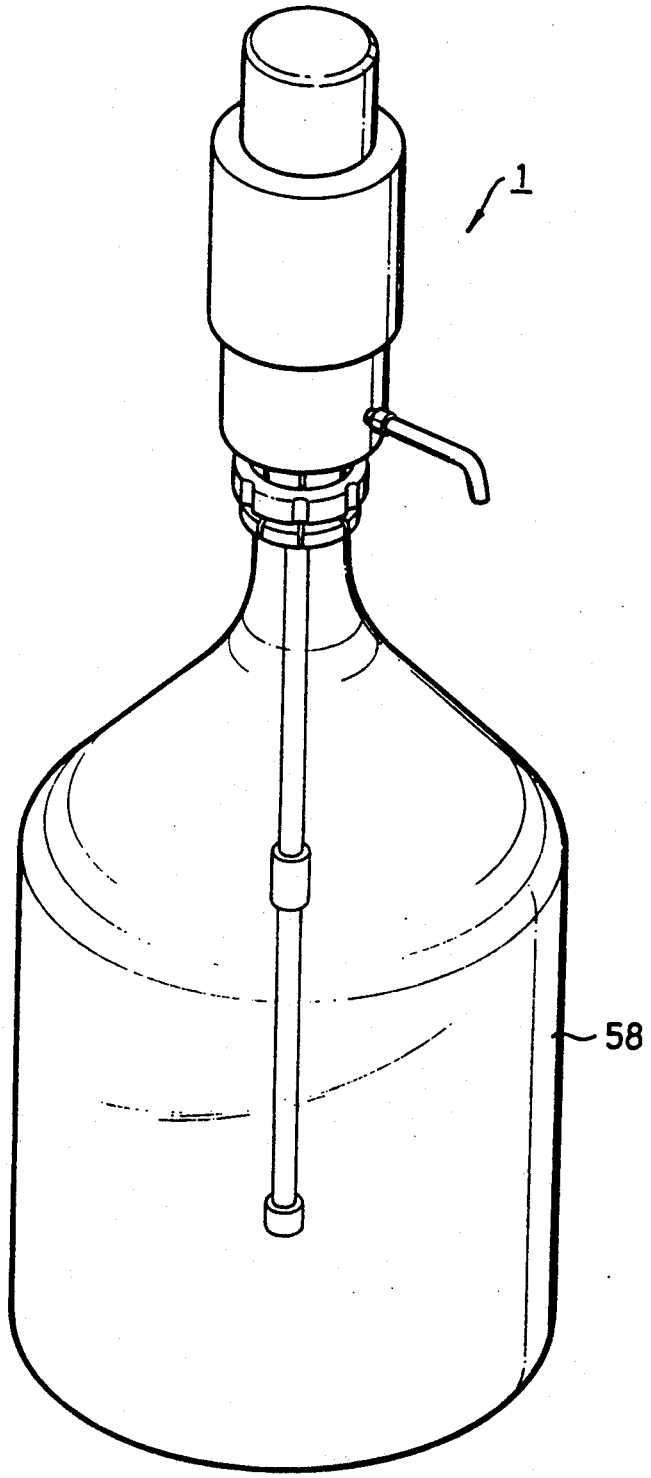
FIG. 1 is a perspective view illustrating a pump in accordance with the invention.
Figure 2:
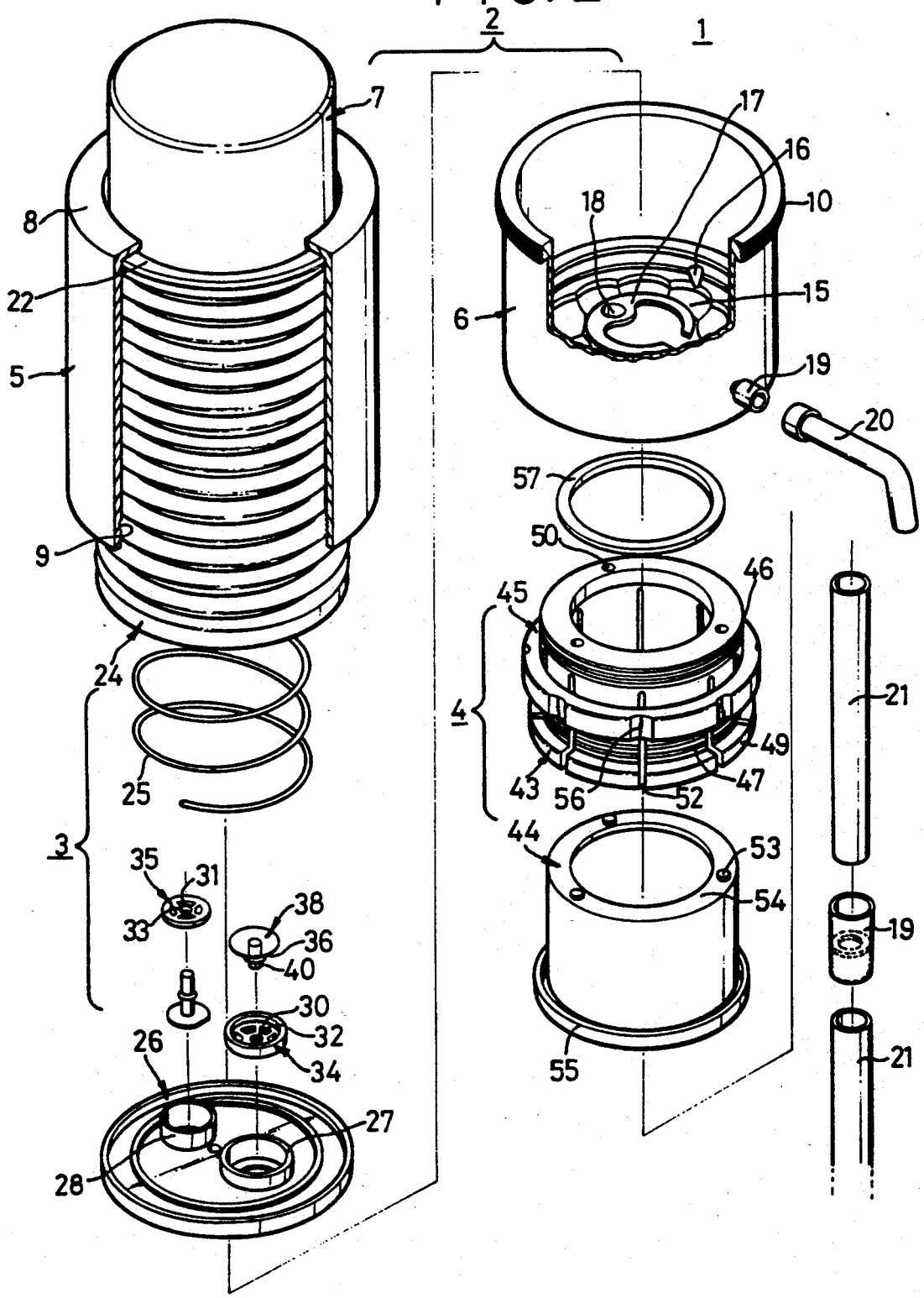
FIG. 2 is an exploded perspective view of the invention.
Figure 3:
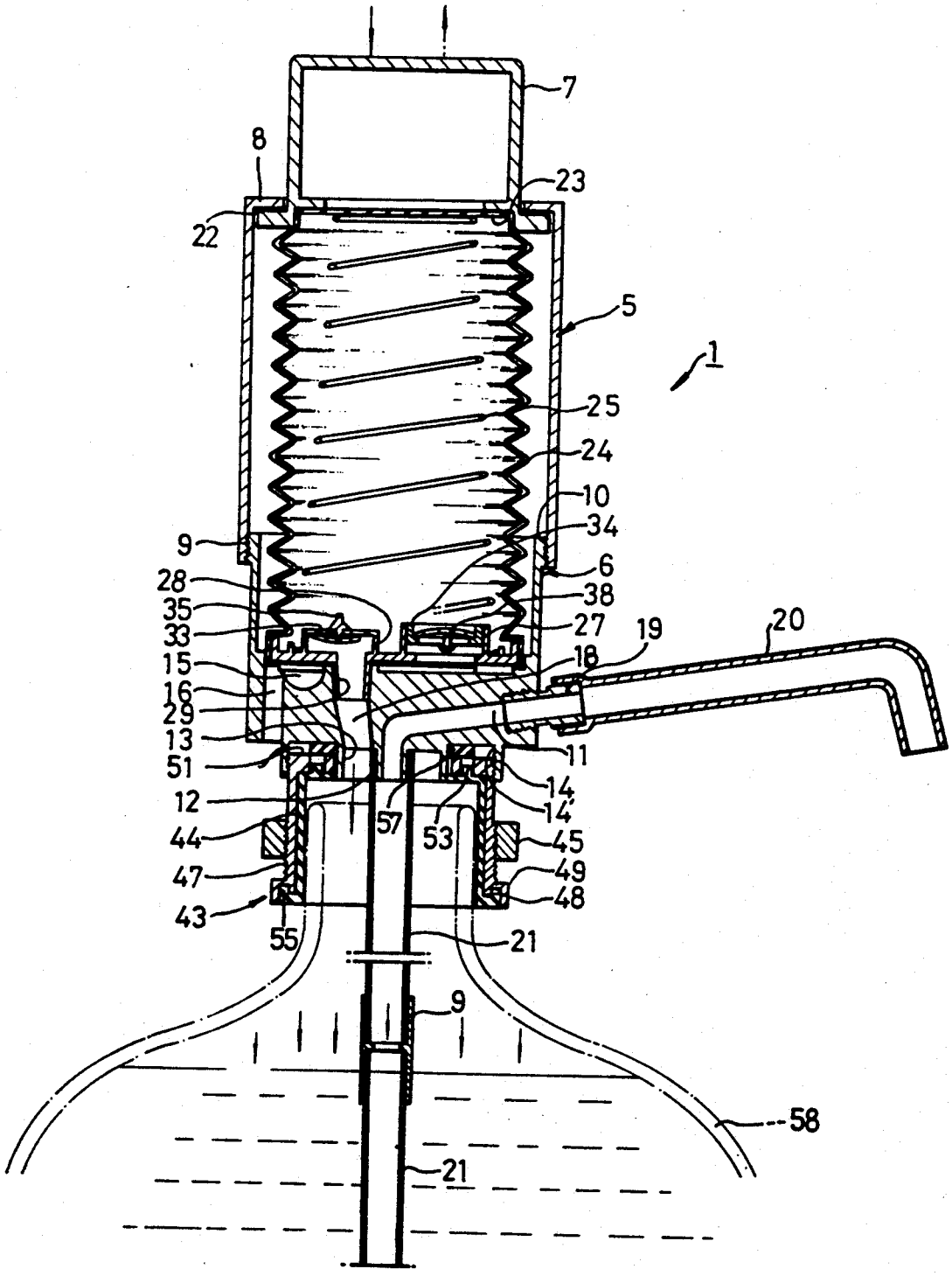
FIG. 3 is an elevational view of the invention.
Figure 4:
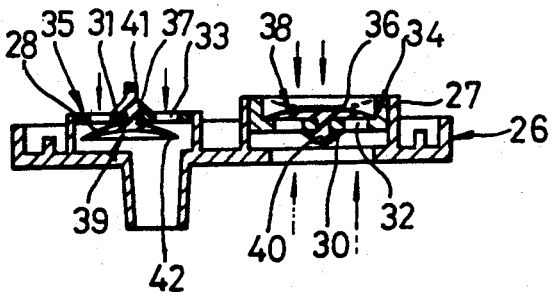
FIG. 4 is an operational view of an intake and outtake plate in accordance with the invention.

Referring to FIGS. 2 through 4 illustrating the preferred embodiment according to the invention, numeral 1 is an air pump, which comprises a cover member 2, a shrinkable cylinder member or bellows 3 and a stopper member 4.

The cover member 2 comprises upper and lower cylinders 5 and 6 and a head 7.

The upper cylinder 5 has a tubular shape, in which an annular flange portion 8 is defined on the top thereof, and a threaded portion 9 on the outer periphery surface of the bottom thereof.

The lower cylinder 6 has a tubular shape of which the bottom is closed, in which a threaded portion 10 is defined on the outer periphery surface of the top thereof, an outlet 11 is defined to the one side wall of the outer periphery surface at the bottom surface thereof, a connecting pipe 12 is protruded to the lower surface of the outlet 11 and a support annular wall portion 13 and a stopple fixed annular wall portion 14 having a threaded portion 14' are protruded to the periphery edge of the connecting pipe 12.

Further, a circular air guide groove 15 is formed in the bottom surface of the lower cylinder and an air intake opening 16 is downwardly penetrated at both ends of the groove 15 to be communicated into the atmosphere and snap ring-type protrusion 17 is formed in central thereof to communicate into the air guide groove. An air outlet opening 18 is penetrated in the protrusion 17 so as to direct within the support annular wall portion 13, and a connecting pipe 19 is threaded in a wall side of the outer periphery surface of the outlet 11 and then a tap attachable elbow pipe 20 is connected upward slopingly and inflow pipe 21 is connected to the lower surface of the connecting pipe 12.

The head 7 may be formed of an annular flange portion 22 on the outer peripheral edge of the lower end thereof and a safe receiving groove 23 on the bottom surface thereof.

In assembly of cover member 2, the threaded portions 9 and 10 are formed in the upper and lower cylinders 5 and 6 and are threaded to integrate each other, the head 7 is inserted from the inside of the upper cover 5 so that the annular flange portion of the head 7 can be caught in the annular flange portion 22 of the upper cylinder 5 as well as the head 7 making a free appearance and disappearance.

The shrinkable cylinder or bellows member 3 comprises a cylinder 24, a spiral spring 25 and an intake and plate 26.

The lower portion of the cylinder or bellows 24 is open and incorporates the spiral spring 25 therein which extends the bellows due to the resilience of the spring.

The intake and output plate 26 has intake and outtake annular walls 27 and 28 protruding therefrom respectively on the top surface thereof so that two annular walls 27 and 28 communicate up and down while a guide pipe 29 is projected from the lower surface of the output annular wall 28. The axial valve openings 30 and 31 are formed in the center of two annular walls 27 and 28 and a circular intake plate 34 and a circular output plate 35, in which a plurality of apertures 32 and 33 are arranged in a circle are inserted and fixed respectively into the walls. The axles 40 and 41 of the intake valve 38 and the press valve 39 in which the annular protrusions 36 and 37 are formed, respectively, are inserted into the axial valve openings 30 and 31, the intake valve 38 being positioned on the top of the circular intake plate 34 and the valve 39 on the bottom of the circular output plate 35 so as to be conversely operated against each other.

At this time, the intake valve 38 and the press valve 39 are opened and closed the apertures 32 and 33 of the cicular input plate 34 and the circular output plate 35, respectively, but a partial aperture 33 of the circular output plate 35 may be always opened by forming a cutting portion 42 by which a part of the press valve 39 is cut.

Accordingly, in assembly of the shrinkable cylinder member 3, the spiral spring 25, which is resiliently disposed in the shrinkable cylinder 24, is disposed to be contacted to the top surface of the input and output plate 26 and the outer peripheral surface of the lower portion of the shrinkable cylinder 24 is both wrapped the periphery edge of the outer peripheral surface and the lower suface of the input and output plate 26 and is fixed and sealed hermetically by way of adhesion.

Then, in assembly of the cover member 2 and the shrinkable cylinder member 3, as described above, the shrinkable cylinder member 3 is arranged in the upper and lower cylinders 5 and 6 prior to assembling the cover member 2. The upper end of the assembling shrinkable cylinder 24 is closely fitted into the safe receiving groove 23 of the head 7 and the intake and plate 26 is put into the bottom surface of the lower cylinder 6. The input valve 38 of the intake and output plate 26 is communication with the air guide groove 15 while the guide pipe 29 of the press valve 39 is inserted into the air outlet opening 18 to communicate therewith.

It may be preferable that the intake and press valve 38 and 39 are made of a rubber material.

The stopper member 4 comprises a bottle stopper 43, a sealing cap 44 and a locking nut 45.

The bottle stopper 43 has a shape so that the upper thereof is narrow and the lower thereof is broad. Threaded portions 46 and 47 are formed in the upper and lower portions of the outer peripheral surface thereof, respectively. Included are an annular protrusion 49 in which an annular groove 48 is formed in the lower end and an annular flange 51 in which a plurality of coinciding holes 50 are equally spaced. A plurality of cut-out slots 52 are equally spaced from the bottom of the upper threaded portion 46 to the annular protrusion 49 in the outer periphery surface.

The sealing cap 44 is made of rubber and forms an annular flange portion 54 in which a plurality of coinciding projections 53 are evenly spaced on the top end thereof and an annular protrusion 55 is formed on the bottom end thereof.

The locking nut 45 is engaged with the lower threaded portion 47 of the bottle stopper 43 to be tightened and having a shape such that the upper thereof is narrow and the lower thereof is broad.

A plurality of knobs 56 are formed on the outer peripheral surface of the locking nut 45 such that a user can easily tighten and loosen the nut.

In assembly of the stopper member 4, the sealing cap 44 is inserted into the inside of the bottle stopper 43 and the coinciding projection 53 is coincidingly inserted into the coinciding hole 50 of the bottle stopper 43. Then the annular protrusion 55 of the sealing cap 44 is screwed in the lower threaded portion 47 of the bottle stopper 43.

The stopper member 4 is then engaged with the cover member 2 so that the upper threaded portion 46 of the bottle stopper 43 is threaded in the threaded portion 14' of the lower cylinder 6 and integrated therewith. A packing 57 made of rubber is disposed between the lower cylinder 6 and the bottle stopper 43, thereby maintaining airtightness.

On the other hand, the inflow pipe 21 is used in accordance with level of the content of the water bottle 58. If the length of the pipe is short, two pipes 21 can be connected by a connecting joint 59.

When the air pump 1 of the invention as constructed above is disposed on the water bottle 58, the mouth of the bottle 58 can be inserted into the sealing cap 44, whether the mouth is threaded or not.

Since the bottle stopper 43 has a shape such that the top thereof is narrow and the bottom thereof is broad and the cut-out slots 52 are formed, the bottle stopple 43 is easily widened, though the inlet of the water bottle 58 is wider than the stopple, so that the sealing cap 44 made of rubber and integrated therewith is resiliently widenable, thereby easily inserting onto the mouth of the bottle 58.

Since the stopple member 4 is strongly fixed by fastening the locking nut 45, the air pump 1 will be fixed in the water bottle 58.

At this time, the inflow pipe 21 disposed to the air pump 1 is inserted in the bottle 58, the end of which is disposed to be closely placed with the bottom surface of the bottle 58.

By using the air pump 1 of the invention as disposed above, if one wishes to drink the natural mineral water, the head 7 is pressed.

The collapsible cylinder 24 is compressed by pressing the head 7 so that the spiral spring 25 disposed therein is compressed.

As the air which is in the collapsible cylinder 24 is exhausted by compressing, the radial valve opening 32 of the circular intake plate 34 is closed by the air pressure at the intake 38 so that the air is not taken into the intake valve 38. As a result, the air is taken into the press valve 39 so that the radial valve opening 33 of the circular output plate 35 is opened by pressure at the press valve 39.

The press valve 39 is inserted about the annular protrusion 37 of the axle 41 so that the opening 33 is opened by widening the press valve.

Of course, since the cutting portion 42 is formed in the press valve 39, the air can flow out through the partly opened radial valve opening 33, but as it is opened so much as that much air and pressure cannot flow out through the opening, the valve is widened so that the exhausted air is pulled by the press valve 39 and simultaneously the air is exhausted.

Accordingly, the air which flows into the press valve 39 is guided into the bottle 58 through the air outlet opening 18 of the lower cylinder 6.

As stated above, when the air flows into the bottle 58, atmospheric pressures in the space not occupied by the water in the bottle, on the surface of the water filled in the bottle 58 and in the inflow pipe 21 are the same. Accordingly, atmospheric pressure is applied in the space, except for the water-occupied space in the pipe, too.

It will be found that the inflow pipe 21 communicates with the outlet 11 of the lower cylinder 6, outlet 11 communicates with the elbow pipe 20, and elbow pipe 20 is exposed to atmospheric pressure thereby applied to the inflow pipe 21.

Even though the air pump 1 was assembled on the bottle 58, the atmospheric pressure in the bottle is not reduced or increased because the bottle 58 is at atmospheric pressure. Accordingly, the air pressure in the bottle 58 is similar to the atmospheric pressure as is the pressure on the surfaces of water in the bottle 58 and the inflow pipe 21 which keep balance with each other.

In this state, by pressing the head 7, the air in the shrinkable cylinder 24 flows into the bottle 58 so that both pressures interrupted the balance.

The surface of the water in the bottle 58 having both pressures, the pressure in the bottle 58 is higher than that in the inflow pipe 21. Accordingly, the water flows toward the lower pressure through the inflow pipe 21, outlet 11 and elbow pipe 21. When the head 7 is continuously compressed, air pressure is continuously applied to the surface of the water so as to continuously drain the water.

To adjust the content of the water, draining is stopped by removing the force which is applied to the head 7. In removing, the elasticity of the spiral spring 25 disposed in the head 7 tends to expand the collapsible cylinder 24. Suction force occurs in the collapsible cylinder 24 so that the air in the bottle 58 is introduced into the collapsible cylinder 24 through the output valve 39. When the air is introduced adversely, the press valve 39 is interrupted, the radial valve opening 33 of the circular output plate 35 by the air pressure but a part of valve 39 is formed the cutting portion 42 and the part of opening 33 is always opened by the cutting portion 42 so that the air drained through the part of opening 33 is introduced into the shrinkable cylinder 24.

The intake valve 38 communicates with the air guide groove 15 of the lower cylinder 6 and the air guide groove 15 communicates with the air intake hole 16 which is penetrated to the lower cylinder so as to communicate with the atmosphere. Consequently the air in the bottle 58 again flows into the collapsible cylinder 24. At the same time, the air in the atmosphere is introduced into the press valve 38, the intake valve 38 is widened by the suction force of the collapsible cylinder 24 so as to introduce the air into the radial valve opening 32 of the circular intake plate 34 in the same manner that the press valve is widened.

Of course, the amount of air received from the intake valve 38 is larger than that returned from the press valve 39.

When the air introduced from the intake and press valves 38 and 39 fills the shrinkable cylinder 24 so as to be returned by the spiral spring 25 in position, the air pressures in the shrinkable cylinder 24 and in the bottle 58 and sucked into the intake valve 38 become the atmospheric pressure, so that the pressure applied to the surface of the water in the bottle 58 is extinguished, interrupting the supply of draining water into the inflow pipe 21.

The air pressure in the bottle 58 is continuously reventilated into the collapsible cylinder 24 as the collapsible cylinder 24 is returned in position, and then is mixed with the air which is introduced into the collapsible cylinder 24 so that the air pressure in the bottle 58 is naturally extinguished. At that time, the pressure in the inflow pipe 21 is higher than that in the bottle so that the water is not drained into the elbow pipe 20 and is retained in the bottle 58.

As stated above, the supply of the water is momentarily interrupted.

According to the above operation, the supply of water is determined by the dropped height of the head 7 and thus the user can adjust the supply voluntarily.

The end of the elbow pipe 20 may be inclined upwardly so as to prevent the water rising in the elbow pipe 20 from dropping outwardly. When the compression is removed, the water is withdrawn into the bottle.

The annular flange portion 22 of the head 7 may be struck under the annular flange portion 8 of the upper cylinder 5 so as to prevent the head 7 from separating due to the elasticity of the spiral spring 25.

Figure 5:
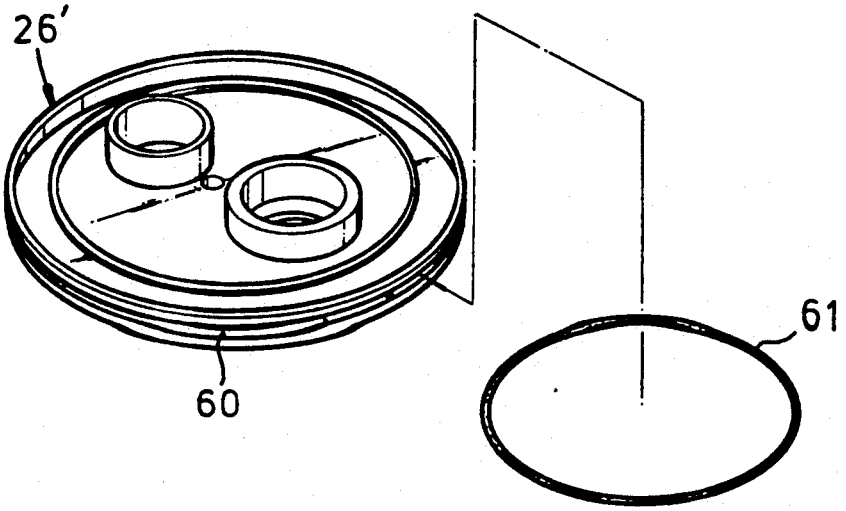
FIG. 5 is a view illustrating a modified intake and outtake plate.

Referring now to FIG. 5, there is shown an embodiment of the input and output plate 26' having a recess 60 into the circumferential direction on the outer periphery surface. In assembly of the shrinkable cylinder member 3, the outer periphery surface of the lower portion of the shrinkable cylinder 24 put into the outer periphery surface of the input and output plate 26' and then a ring 61 made of rubber or the like is inserted into the recess 60 of the plate 26' as so to be fixed and sealed.

Figure 6:
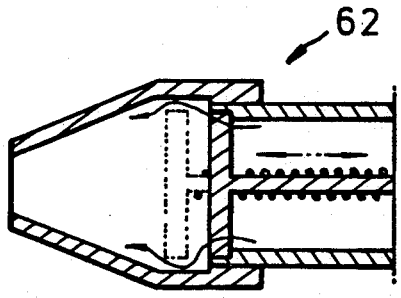
FIG. 6 is view illustrating a tap which can be mounted on to the elbow pipe of FIG. 1.

If a carbonated drink is the bottle, the natural flavor of the drink may deteriorate through loss of the gas over many hours. To solve this problem, a tap 62 such as shown in FIG. 6 may be connected to the end of the elbow pipe 20.

While there has been described what is at present considered to be the preferred embodiment of the invention, it will be understood that various modifications may be made therein. and it is intended to cover in the appended claims all such modifications as fall within the true spirit and scope of the invention.

What is claimed is:

1. An air pump for a natural mineral water bottle, said pump comprising:

a cover member comprising an upper cylinder having a top and bottom with an annular flange defined on the top thereof and inner threads at the bottom thereof, a lower cylinder having an upper end threadably connected to the bottom end of the upper cylinder, the lower cylinder having an outlet communicating with one side wall of an outer peripheral surface positioned at a bottom surface thereof, a connecting pipe extending downwardly from said outlet, a circular guide groove formed in a circular in the bottom surface, an air intake opening communicating with both ends of said groove so as to communicate with the atmosphere, a snap ring formed in a central portion of said groove, said snap ring being penetrated by an air outlet opening and being connected upward slopingly by an elbow pipe to said outlet of the outer peripheral surface of said lower cylinder, and a head formed with an annular flange portion, said head being inserted from the inside of said upper cylinder to project through the annular flange at the top of the upper cylinder;

a bellows member including a spiral spring disposed therein and an input and output plate fixed hermetically by way of adhesion in a lower end thereof, said input and output plate having an input and an output annular wall on a top surface thereof so that two annular walls are communicated vertically, a guide pipe projecting from a lower surface of said output annular wall, axial valve openings formed in the center of two annular walls, a circular input valve plate and a circular output valve plate in each of which include a plurality of apertures arranged in a circle, the input and output valve plates being inserted and fixed respectively into the two annular walls, an input valve being positioned at the top of said input valve plate so as to be conversely operated thereagainst, the input valve being always opened with a partial aperture of said input plate by forming a cut portion in said input valve, a press valve being inserted into said air outlet opening for communication therewith, said bellows member being disposed within said cover member such that said bellows is received in a bottom portion of said head with said input and output plate abutting the bottom surface of said lower cylinder, said input valve of said plate being in communication with said air guide groove, and a stopper member comprising a bottle stopper having a threaded portion and an annular protrusion in which an annular groove is formed in a lower end thereof, the stopper member including an annular flange in which a plurality of coinciding holes are constantly spaced and a plurality of cut-out slots constantly spaced in an outer peripheral surface thereof; a locking nut threaded to said threaded portion of said bottle stopper, said bottle stopper of said stopper member being threaded in a stopper fixing annular wall of the lower cylinder with a packing member made of a rubber disposed so as to retain airtightness therebetween, one end of an inflow pipe being connected to said outlet at the bottom surface of said lower cylinder and the other end of the inflow pipe, the bottle stopper and the sealing cap being mounted on the mouth of the bottle and being fixed hermetically by screwing said locking nut down on the threaded portion.

2. An air pump as claimed in claim 1 in which the input and output plate has a recess extending in the circumferential direction on an outer peripheral surface thereof so as to receive a sealing ring.

3. An air pump as claimed in claim 1 further including a tap connecting to one end of said elbow pipe.

* * * * *